US005760758A

United States Patent [19]

Seike et al.

[11] Patent Number: 5,760,758

[45] Date of Patent: Jun. 2, 1998

[54] METHOD OF DRIVING DISPLAY DEVICE

[75] Inventors: Takeshi Seike, Kitakatsuragi-gun; Masahiro Ise, Kashihara; Koichi Kajimoto, Tenri, all of Japan

[73] Assignee: Sharp Kabushiki Kaisha, Osaka, Japan

[21] Appl. No.: 499,162

[22] Filed: Jul. 7, 1995

[30] Foreign Application Priority Data

Jul. 15, 1994 [JP] Japan ..... 6-163872

[51] Int. Cl.[6] ..... G09G 3/36

[52] U.S. Cl. ..... 345/95; 345/87; 345/94

[58] Field of Search ..... 345/87, 94, 95, 345/96, 91

[56] References Cited

U.S. PATENT DOCUMENTS

| | | | |
|---|---|---|---|
| 5,379,050 | 1/1995 | Annis et al. | 345/94 |
| 5,424,753 | 6/1995 | Kitagawa et al. . | |
| 5,428,370 | 6/1995 | Knapp et al. | 345/205 |
| 5,526,013 | 6/1996 | Ono et al. | 345/208 |

FOREIGN PATENT DOCUMENTS

| | | |
|---|---|---|
| 0588517 A1 | 3/1994 | European Pat. Off. . |
| 0607860 A1 | 7/1994 | European Pat. Off. . |
| 5-100637 | 4/1993 | Japan . |
| 5-93898 | 4/1993 | Japan . |
| 6-68712 | 9/1993 | Japan . |
| 5-323385 | 12/1993 | Japan . |
| WO 94/00791 | 6/1994 | Japan . |

*Primary Examiner*—Richard Hjerpe
*Assistant Examiner*—Kent Chang
*Attorney, Agent, or Firm*—Nixon & Vanderhye P.C.

[57] ABSTRACT

A method of driving a display device having a plurality of signal electrode lines, a plurality of scanning electrode lines, and a display element and a 2-terminal type non-linear element connected to each other in series between each signal electrode line and each scanning electrode line, in which a selected period is divided into a writing period for charging the display element with more than a certain amount of charge through the 2-terminal type non-linear element and an erasing period following the writing period, and a second voltage which has a polarity reverse to that of the first voltage and does not erase the charge charged in the writing period is applied in the erasing period to turn on the display element. The after-images can be reduced significantly, and the tolerance of the second voltage required to obtain high-contrast can be broadened.

10 Claims, 9 Drawing Sheets

ON
OFF
SELECTED PERIOD
SELECTED PERIOD
V0
V1
V2
V3
V4
V5

V0
V1
V2
V3
V4
V5

+Vop
+Voff
+Von
-Von
-Voff
-Vop

ON
OFF
SELECTED PERIOD
SELECTED PERIOD
V0
V1
V2
V3
V4
V5
V6
V7

V0
V1
V2
V3
V4
V5
V6
V7

+Vop
+Voff
+Von
+VP
+Vb
-Vb
-VP
-Von
-Voff
-Vop

METHOD OF DRIVING DISPLAY DEVICE

FIELD OF THE INVENTION

The present invention relates to a method of driving a display device having a display element represented by a liquid crystal element or the like, and a 2-terminal type non-linear element serving as a switching element connected to the display element in series.

BACKGROUND OF THE INVENTION

Recently, a liquid crystal display device has been used in various fields including AV (Audio and Visual) systems and OA (Office Automation) systems. The products in the low end are furnished with a passive type liquid crystal display device comprised of a TN (Twisted Nematic) or STN (Super Twisted Nematic), while those in the high end are furnished with an active matrix driven liquid crystal display device using a 3-terminal type non-linear element, or namely a TFT (Thin Film Transistor), as a switching element.

Since the active matrix driven liquid crystal display device surpasses the CRT (Cathode Ray Tube) in color reproduction ability, thinness (less deep), lightness, and low power consumption, the use thereof has been diversified rapidly. However, a thin film forming process and a photolithographic process must be repeated six to eight times to make the TFT, and using the same as the switching element increases the manufacturing costs. Thus, to save the manufacturing costs is the most crucial problem at present.

In contrast, a liquid crystal display device using a 2-terminal type non-linear element as the switching element is advantageous over the one using the TFT in terms of manufacturing costs, and is also advantageous over the passive type liquid crystal display device in terms of display quality. Therefore, the liquid crystal display device of this type has been developed explosively.

As shown in FIG. 7, the liquid crystal display device using the 2-terminal type non-linear element comprises a display panel 21, a scanning electrode driving circuit 22 which applies a predetermined voltage to scanning electrode lines of the display panel 21 line-sequentially, a signal electrode driving circuit 23 which applies a predetermined voltage corresponding to the display to signal electrode lines of the display panel 21, and a control unit 24 which sends control signals to both the scanning electrode driving circuit 22 and signal electrode driving circuit 23 to display the input data.

As shown in FIG. 8, the display panel 21 includes a plurality of liquid crystal elements 25 in matrix arrangement. To be more specific, one liquid crystal element 25 is connected to a 2-terminal type non-linear element 26 in series between each of the scanning electrode lines (Y1-Ym) and signal electrode lines (X1-Xn) in grid form.

Although it is not shown in the drawing, the scanning electrode driving circuit 22 comprises a liquid crystal driving power generating circuit, a shift register, and an analog switch, while the signal electrode driving circuit 23 comprises a shift register, a latch circuit, and an analog switch.

According to the above structure, as shown in FIG. 9, a signal 31 and a signal 32 are applied across the scanning electrode line Yi and signal electrode line Xj to turn on and off the liquid crystal element 25, respectively.

The 2-terminal type non-linear element 26 has a property that the equivalent resistance thereof decreases as the applied voltage increases, which causes an abrupt increase of the current when a larger voltage is applied. As a result, the voltages indicated respectively by broken lines in FIGS. 10(*a*) and 10(*b*) are applied across the liquid crystal element 25. This means that the voltage applied to the liquid crystal element 25 while it is selected (selected period) remains when it is no longer selected (non-selected period).

For the above reason, the active matrix liquid crystal display device using the 2-terminal type non-linear element 26 enables a high duty driving compared with a simple matrix type liquid crystal display device, thereby achieving higher contrast and more uniform display.

However, the conventional structure as above has a problem that an after-image or sticking occurs easily.

More specifically, with the liquid crystal display device set in a normally white mode in which the liquid crystal elements 25 show black when turned on, when the display panel 21 that has been showing white at the center and black at the edge as shown in FIG. 11(*a*) for some time is switched to show an intermediate level, or namely grey, entirely, then the previously-shown pattern remains and does not make the display uniform over the entire display panel 21 as shown in FIG. 11(*b*).

The after-image is caused by the fact that the I–V (Current versus Voltage) characteristics of the 2-terminal type non-linear elements 26 depends on the voltage applying time. That is to say, as shown in FIG. 12, the I–V characteristics of the non-linear element 26 shift to a curved line 33*b* from a curved line 33*a* over the voltage applying time. Accordingly, the T-V (Transmission coefficient versus Voltage) characteristics of the liquid crystal elements 25 shift to a curved line 34*b* from a curved line 34*a* as shown in FIG. 13. For example, a voltage with a transmission coefficient of 50% shifts from $V_{50}$ to $V_{50}$, in the drawing; however, note that the amount of shift varies depending on the applied voltage.

Thus, as shown in FIG. 14, the shift amount ΔV (curved line 35*a*) of the voltage required to turn on the liquid crystal element 25 becomes larger than the shift amount ΔV (curved line 35*b*) of the voltage required to turn off the same, thereby causing the after-image.

To reduce the after-images, Japanese Patent Publication No. 5-68712/1993 discloses a method, in which the selected period is divided into two periods, the first and second periods, and an adjusting charge is given to an electro-optical element represented by the liquid crystal display or the like through the non-linear element in the first period to make the initial charge dependency of the non-linear element almost negligible, while a charge corresponding to display input data is given to the electro-optical element through the non-linear element in the second period. As a result, the input data can be displayed independently of the preceding display.

Further, Japanese Laid-Open Patent Application No. 5-323385/1993 discloses a method, in which the polarity of the voltage applied in the first period is reversed to that of a voltage corresponding to the display data applied in the second period and the voltage applied in the first period is made sufficiently large, so that the polarization amount in an MIM (metal-insulator-metal) element as the non-linear element becomes constant, thereby making the polarization amount independent of whether the liquid crystal element is turned on or off. In this way, the input data can be displayed independently of the preceding display.

The above methods can reduce the after-images; however, they have a problem that they limit a tolerance of the applied voltage required to attain high contrast.

SUMMARY OF THE INVENTION

It is therefore the object of the present invention to provide a method of driving a display device which can reduce the after-images and broaden the tolerance of the applied voltage required to obtain high contrast.

To fulfill the above object, a method of the present invention of driving a display device having a plurality of signal electrode lines, a plurality of scanning electrode lines, and a display element and a 2-terminal type nonlinear element connected to each other in series across each signal electrode line and each scanning electrode line, comprising the steps of selecting the scanning electrode lines sequentially per selected period, and applying a voltage across a selected scanning electrode line and a selected signal electrode line to turn on/off a display element connected to the selected scanning electrode line, characterized in that:

the selected period is divided into a writing period for applying a first voltage to charge the display element with more than a certain amount of charge through the 2-terminal type non-linear element, and an erasing period following the writing period; and a second voltage which has a polarity reverse to a polarity of the first voltage and does not erase the charge charged in the writing period is applied in the erasing period to turn on the display element.

According to the above method, the I-V characteristics of the 2-terminal type non-linear element shift in a constant amount whether the display element is turned on or off, thereby reducing the after-images significantly. Moreover, since the second voltage which has a polarity reverse to that of the first voltage and does not erase the charge charged in the writing period is applied in the erasing period to turn on the display element, the tolerance of the second voltage required to obtain high contrast can be broadened.

For a fuller understanding of the nature and advantages of the invention, reference should be made to the ensuing detailed description taken in conjunction with the accompanying drawings.

BRIEF DESCRIPTION OF THE DRAWINGS

FIG. 1(*a*) shows the waveform of a signal applied to a scanning electrode line; FIG. 1(*b*) shows the waveform of a signal applied to a signal electrode line; and FIG. 1(*c*) shows the waveform of a signal applied across the scanning electrode line and signal electrode line.

FIG. 2(*a*) shows the waveform when the liquid crystal element is turned on; and FIG. 2(*b*) shows the waveform when the liquid crystal element is turned off.

FIG. 4(*a*) is a graph obtained using a ratio of a second voltage to a first voltage as a parameter; and FIG. 4(*b*) is a graph obtained using a ratio of a third voltage to the first voltage as a parameter.

FIG. 6(*a*) shows the waveform of a signal applied to the scanning electrode line; FIG. 6(*b*) shows the waveform of a signal applied to the signal electrode line; and FIG. 6(c) shows the waveform of a signal applied across the scanning electrode line and signal electrode line.

FIG. 11(*a*) shows a screen that shows white at the center and black at the edge; and FIG. 11(*b*) shows the screen when it is switched to show an intermediate level, or namely grey, entirely after the screen has shown the display of FIG. 11(*a*) for some time.

DESCRIPTION OF THE PREFERRED EMBODIMENT

An embodiment of the present invention will be explained in the following while referring to FIGS. 1(*a*) through 6(*c*).

Figure 1:
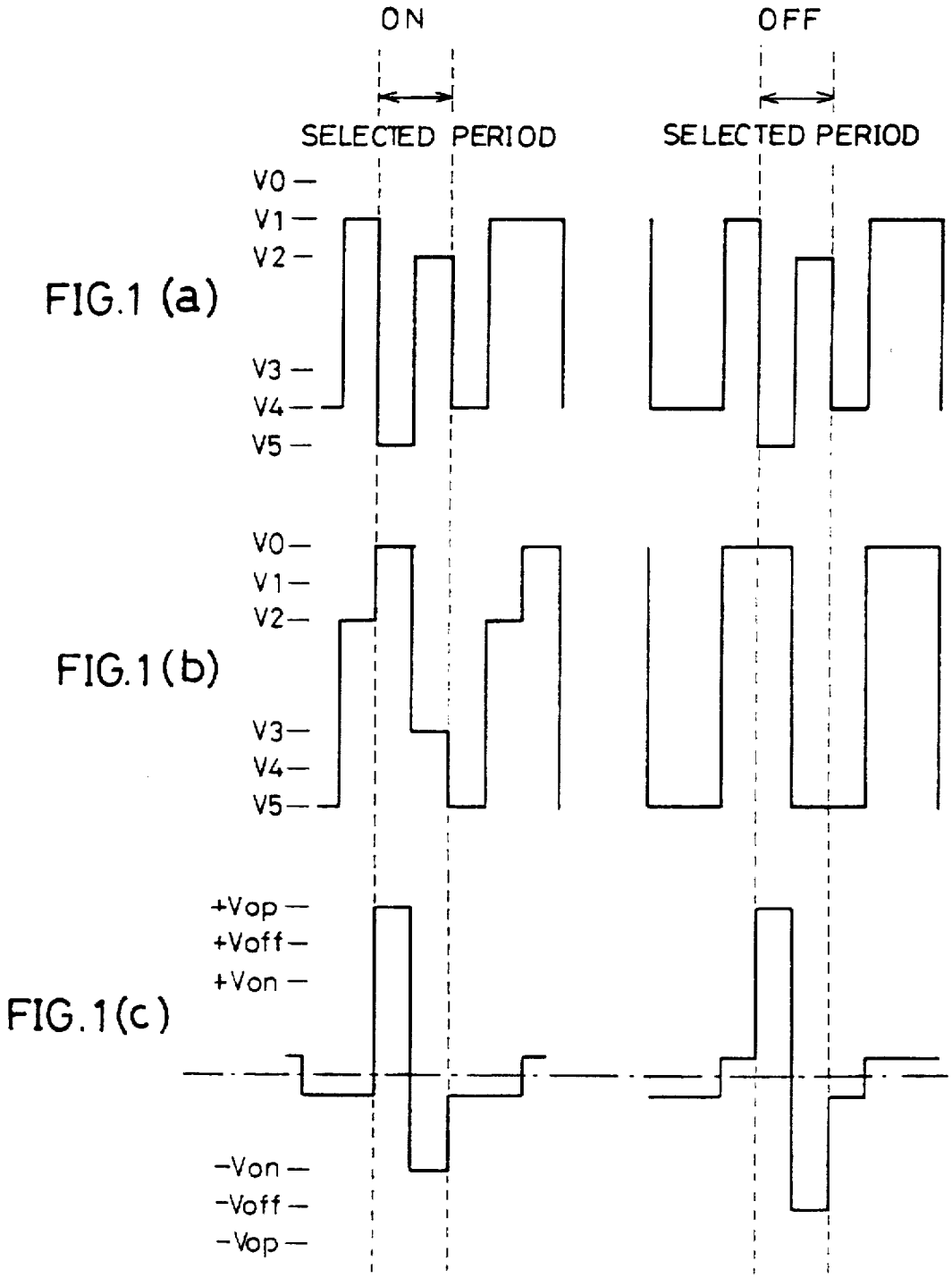
FIGS. 1(*a*) through 1(*c*) are views showing the waveforms representing a driving method of the display device of the present invention.

FIG. 1(*c*) shows a driving voltage applied across a liquid crystal element and a 2-terminal type non-linear element connected to each other in series in a method of driving a liquid crystal display device of the present invention. Note that although the drawing shows only the positive direction, the polarity is reversed every frame or certain number of frames.

In the driving method of the present invention, the selected period is divided into a writing period and an erasing period. In the former, a first voltage (±Vop) is applied to charge the liquid crystal element with more than a certain amount of charge through the 2-terminal type non-linear element. In the latter, which comes after the former, either a second voltage (±Von) or a third voltage (±Voff) is applied through the 2-terminal type non-linear element to keep the liquid crystal element turned on or turn off the same.

More precisely, the second voltage, which has a polarity reverse to that of the first voltage and is smaller than the first voltage so as not to erase the charge charged in the writing period, is applied in the erasing period to turn on the liquid crystal element.

Whereas the third voltage, which has a polarity reverse to that of the first voltage and is smaller than the first voltage but larger than the second voltage so as to erase most of the charge charged in the writing period, is applied in the erasing period to turn off the liquid crystal element.

In short, the first through third voltages are set as follows: Von<Voff<Vop.

Figure 2:
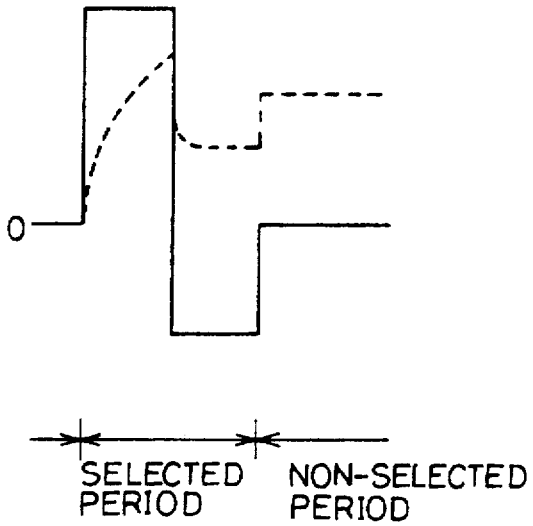
FIGS. 2(*a*) and 2(*b*) are views showing the waveforms of signals applied to a liquid crystal element when the signal shown in FIG. 1(*c*) is applied across the scanning electrode line and signal electrode line.
Figure 2:
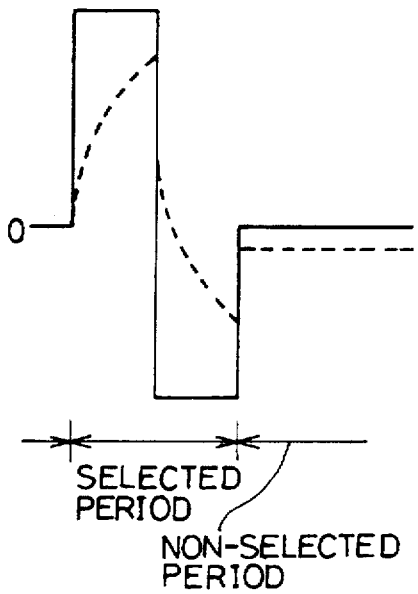

As a result, the voltage applied across the liquid crystal element changes as is indicated by broken lines in FIGS. 2(*a*) and 2(*b*). To be more specific, when the second voltage is applied in the erasing period, the voltage across the liquid crystal element is maintained at a high level in the non-selected period as shown in FIG. 2(*a*), thereby turning on the liquid crystal element. On the other hand, when the third voltage is applied in the erasing period, the voltage across the liquid crystal element drops to almost a zero level as shown in FIG. 2(*b*), thereby turning off the liquid crystal element.

Figure 3:
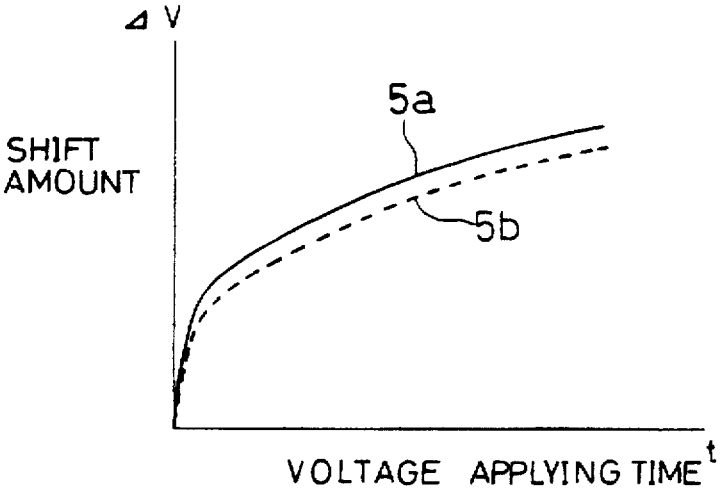
FIG. 3 is a graph showing the shift amount of the voltage required to turn on or off the liquid crystal element over time.

Moreover, since the liquid crystal element is charged with more than a certain amount of charge through the 2-terminal type non-linear element by applying the first voltage in the preceding writing period, the shift amount ΔV (a curved line 5*a*) of the voltage required to turn on the liquid crystal element and the shift amount ΔV (curved line 5*b*) of the voltage required to turn off the same vary almost in the same manner over time as shown in FIG. 3. This eliminates the after-image caused by the 2-terminal type non-linear element.

Figure 4:
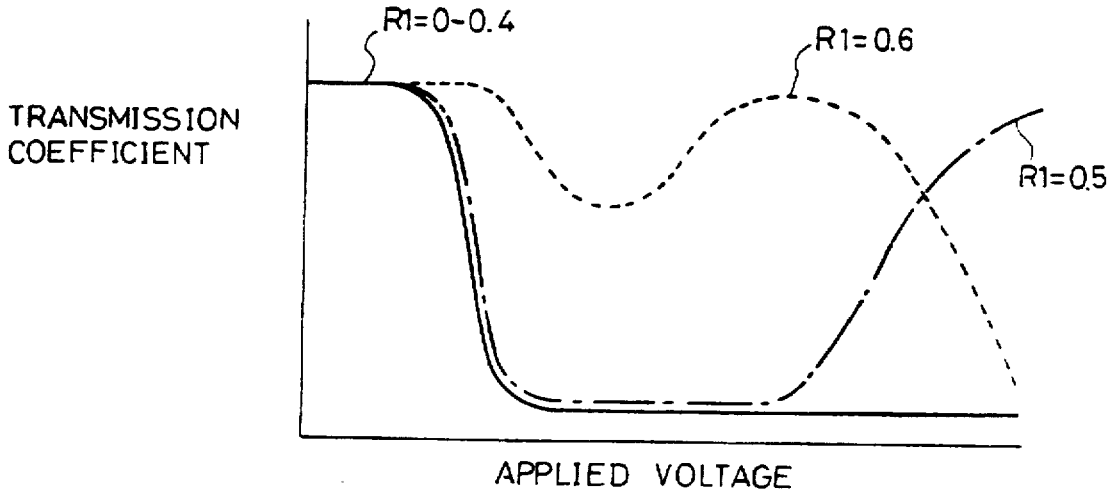
FIGS. 4(*a*) and 4(*b*) are graphs showing the T-V characteristics of the liquid crystal element.
Figure 4:
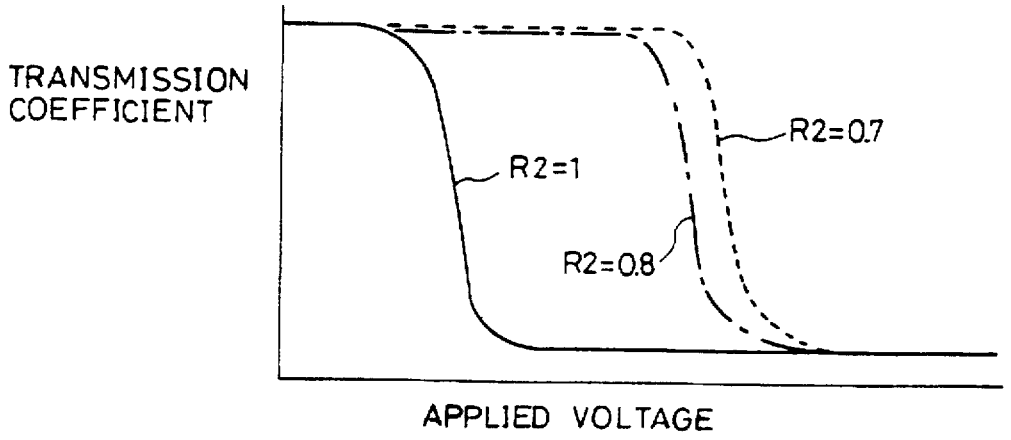

FIG. 4(*a*) shows the T-V characteristics of the liquid crystal element when the ratio of the second voltage to the first voltage, which is referred to as (R1), is in a range from 0 to 0.6 inclusive. FIG. 4(*b*) shows the T-V characteristics of the liquid crystal element when the ratio of the third voltage to the first voltage, which is referred to as (R2), is in a range from 0.7 to 1 inclusive. These graphs are obtained in a liquid crystal display panel under the conditions that the 2-terminal type non-linear element has the I-V characteristics expressed by $I=\alpha\times V\times\exp(\beta\times V^{1/2})$, where $\alpha=10^{-14}$ and $\beta=30$, and the capacity ratio of the 2-terminal type non-linear element to the liquid crystal element is 10:1.

It is obvious from these graphs that good contrast can be attained when the ratio of the second voltage to the first voltage is 0.5 or less, and that of the third voltage to the first voltage is less than 1, preferably more than 0.5 and less than 1.0. Also, it can be understood that good contrast can be attained in a broad range for each of the first through third voltages.

Figure 5:
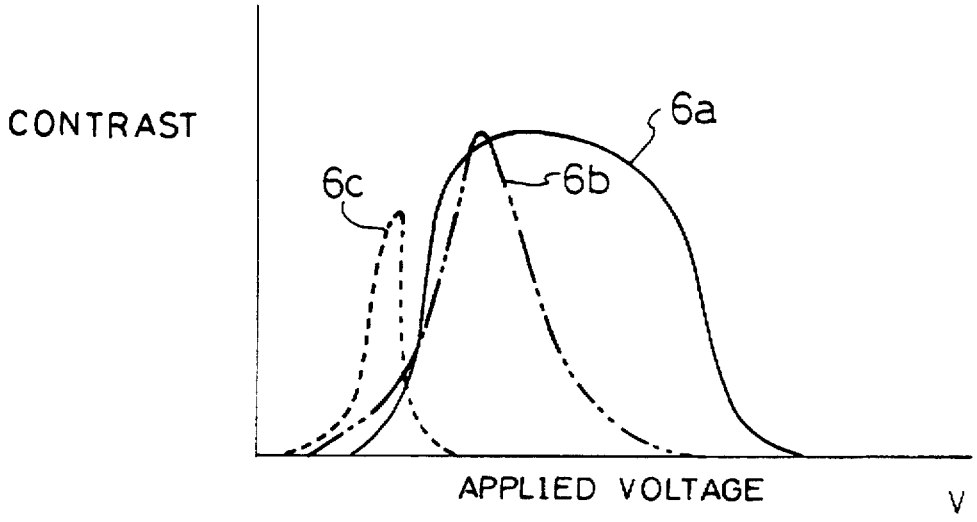
FIG. 5 is a graph showing the contrast versus applied voltage characteristics obtained by the driving method of the present invention and the conventional driving method.

FIG. 5 shows the contrast versus applied voltage characteristics (curved line 6*a*) of the present invention, and those of the conventional driving method (curved lines 6*b* and 6*c*). It can be seen from the drawing that the driving method of the present invention can attain good contrast in a broader voltage applying range compared with the conventional driving method.

In addition, even when the difference between the second and third voltages is small, the resulting contrast is sufficiently high, thereby enabling high contrast without affecting the liquid crystal element connected to a nonselected scanning electrode line.

The first through third voltages can be easily generated using six levels of voltage (V0–V5), which are used to drive the conventional liquid crystal display device. To be more specific, the first voltage is generated by applying V5 (or V0) to the scanning electrode line as shown in FIG. 1(*a*), and V0 (or V5) to the signal electrode line as shown in FIG. 1(*b*). Likewise, the second voltage is generated by applying V2 (or V3) to the scanning electrode line and V3 (or V2) to the signal electrode line, and the third voltage is generated by applying V2 (or V3) to the scanning electrode line and V5 (or V0) to the signal electrode line.

In other words, the first through third voltages are found as follows: Vop=VO–V5, Von=V2–V3, Voff=V2–V5 (or V0–V3).

When the number of levels of voltage is increased to eight by adding V2' and V3' levels, the first through third voltages can be generated separately by applying V2' and V3' to the signal electrode line instead of V2 and V3, respectively.

Figures 6, 6A:
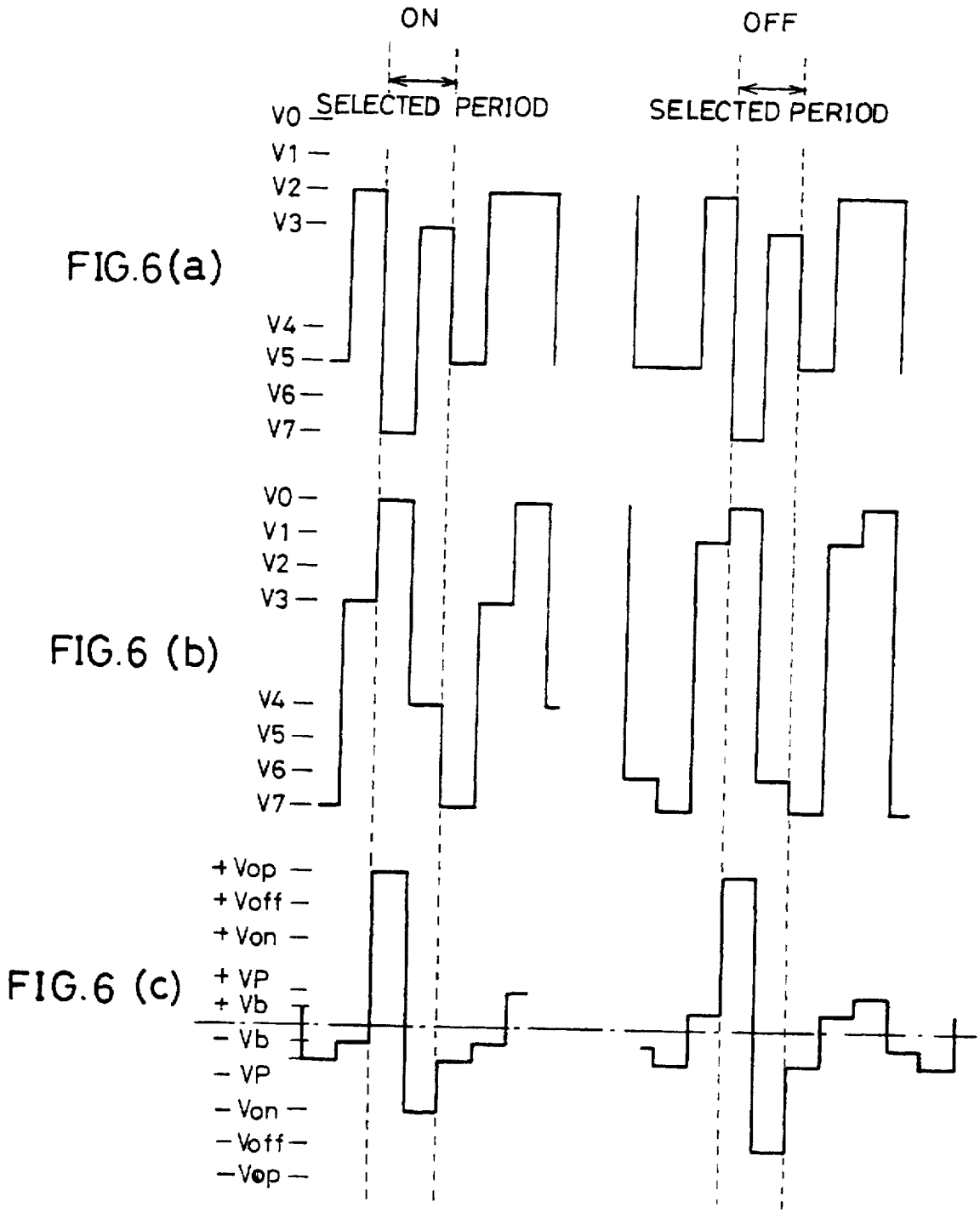
FIGS. 6(*a*) through 6(*c*) are other views showing the waveforms representing the driving method of the display device of the present invention.
Figure 7:
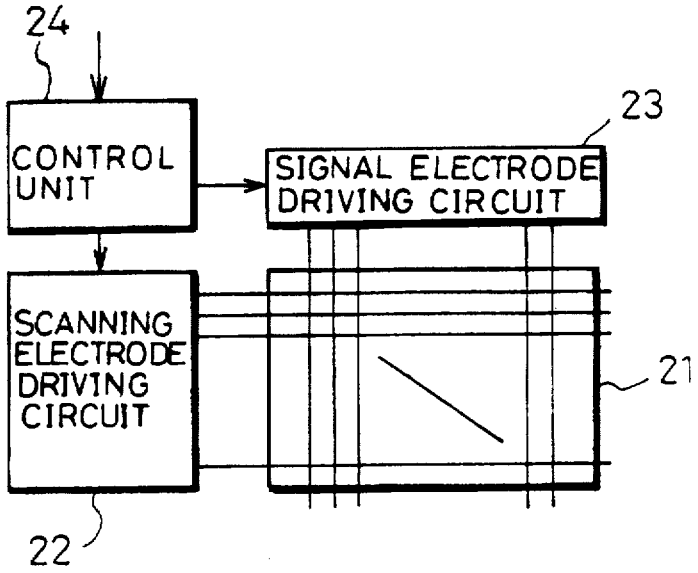
FIG. 7 is a view showing the schematic structure of a conventional liquid crystal display device.
Figure 8:
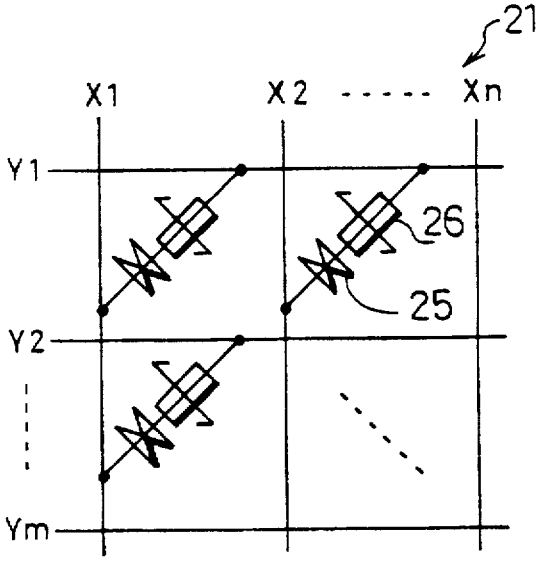
FIG. 8 shows an equivalent circuit of a display panel of the conventional liquid crystal display device.
Figure 9:
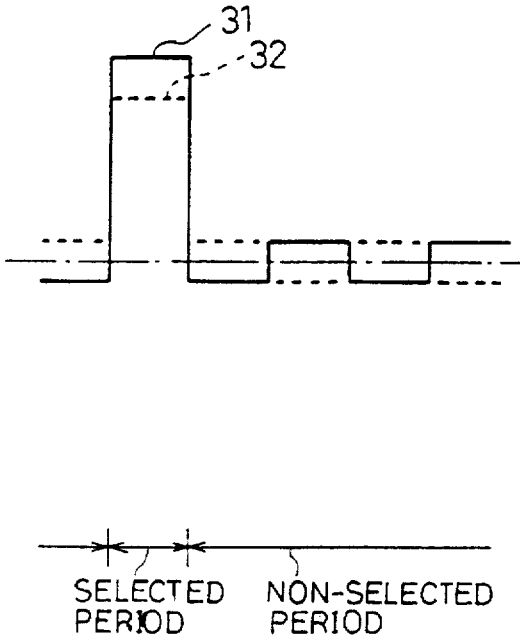
FIGS. 9(*a*) and 9(*b*) are views showing the waveforms representing the driving method of the liquid crystal display device in FIG. 7.
Figure 9:
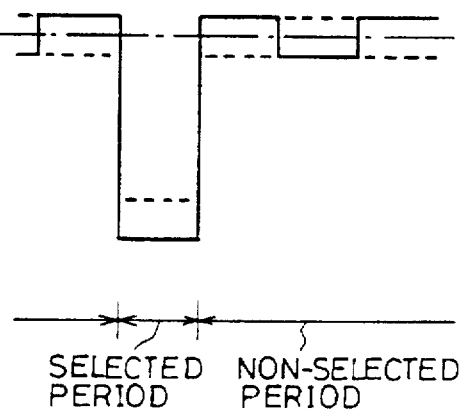
Figure 10:
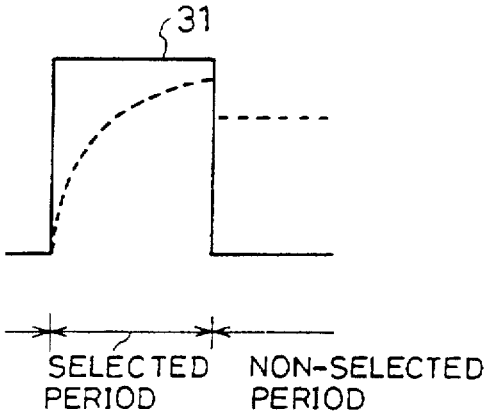
FIGS. 10(*a*) and 10(*b*) are views showing the waveforms of signals applied to the liquid crystal element when the signals of FIGS. 9(*a*) and 9(*b*) are applied across the scanning electrode line and signal electrode line.
Figure 10:
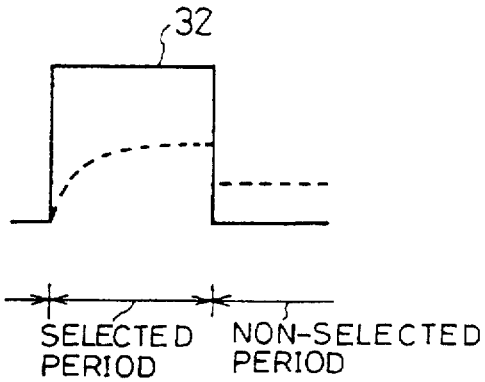
Figure 11:
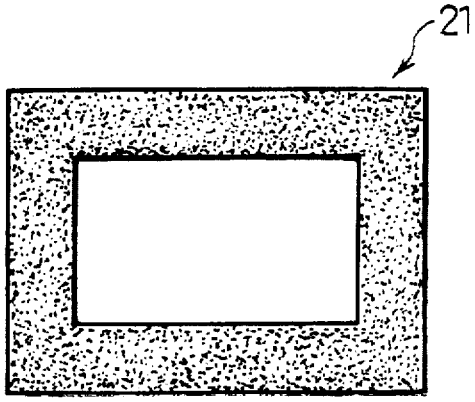
FIGS. 11(*a*) and 11(*b*) are views explaining displayed screens by the driving method of FIG. 9.
Figure 11:
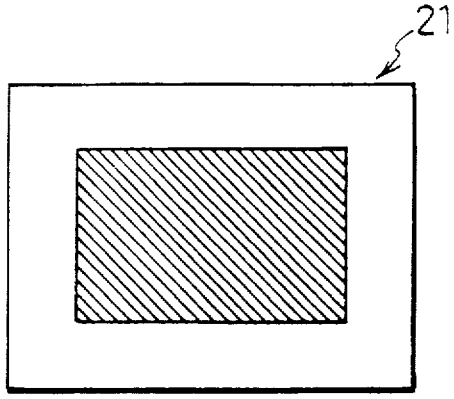
Figure 12:
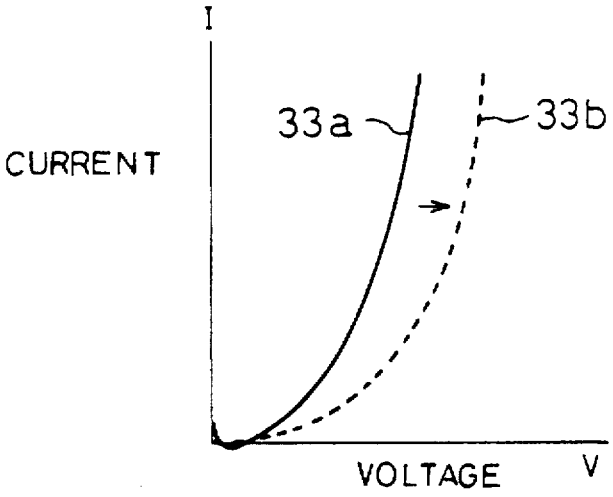
FIG. 12 is a graph showing that the I-V characteristics of the 2-terminal type non-linear element shift over the voltage applying time.
Figure 13:
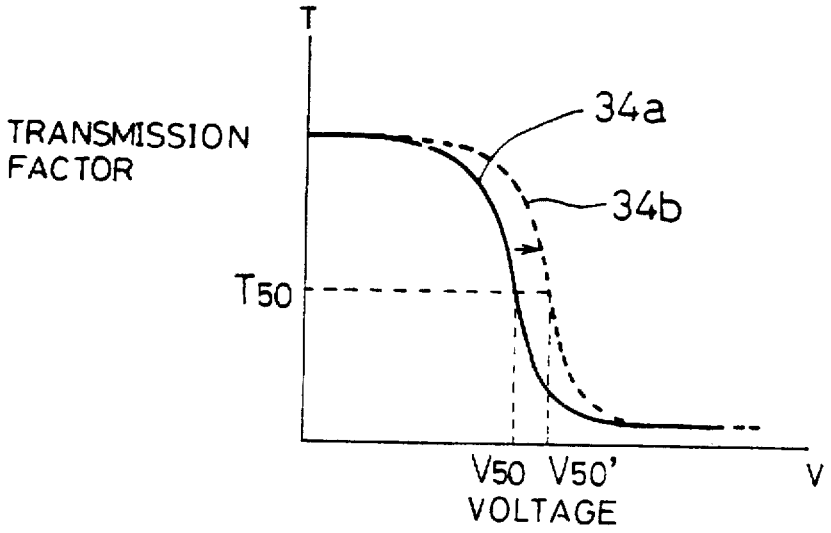
FIG. 13 is a graph showing that the T-V characteristics of the liquid crystal element shift in accordance with the change of the I-V characteristics shown in FIG. 12.
Figure 14:
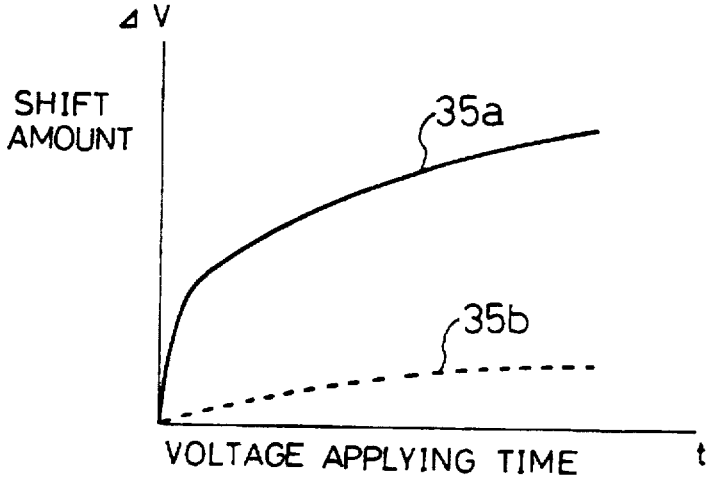
FIG. 14 is a graph showing the shift amount of the voltage required to turn on or off the liquid crystal element over time.

When the scanning electrode line and signal electrode line are driven using the eight levels of voltage (V0–V7) as shown in FIGS. 6(*a*) and 6(*b*), the resulting driving, which is shown in FIG. 6(*c*), is substantially the same as the one shown in FIG. 1(*c*) while the first through third voltages can be set separately.

The first voltage may be, applied in the form of a single pulse or multi-pulse, and the second and third voltages may be applied in the form of a rectangular pulse or triangular pulse in this embodiment.

Further, the selected period is divided into a pair of the writing and erasing periods in this embodiment; however, it may be divided into a set of such pairs. Also, the second voltage may be as large as the third voltage, and, in such a case, the former is applied shorter than the latter in the erasing period.

Moreover, the on/off display of the active matrix type liquid crystal display device using the 2-terminal type non-linear element, such as an MIM element and an MIS (metal-insulator-semiconductor) element, is explained herein as an example of the driving method of the present invention. However, the present invention can be applied to multi-level display using well-known pulse width modulation, frame skip, amplitude modulation, etc.

In addition, the-present invention can be applied to drive the display element having an electrochromic layer, a plasma luminescence layer, and electroluminescence layer instead of the liquid crystal layer.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A method of driving a display device having a plurality of signal electrode lines, a plurality of scanning electrode lines, and a display element and a 2-terminal type non-linear element connected to each other in series across each signal electrode line and each scanning electrode line, comprising the steps of selecting the scanning electrode lines sequentially per selected period, and applying a voltage across a selected scanning electrode line and a selected signal electrode line to turn ON/OFF a display element connected to said selected scanning electrode line, wherein said selected period is divided into a first period for applying a first voltage to charge the display element with more than a certain amount of charge through the 2-terminal type non-linear element to switch ON said display element, and a second period following the first period for applying one of a second voltage for maintaining said display element switched ON, and a third voltage for switching OFF said display element; and the second voltage has a polarity reverse to a polarity of the first voltage and smaller in magnitude than a magnitude of the first voltage, and erases only some of the charge charged in the first period.

2. The method of driving the display device as defined in claim 1, wherein said third voltage has a polarity reverse to the polarity of the first voltage and a magnitude smaller than the magnitude of the first voltage and larger than the magnitude of the second voltage, and erases most of the charge charged in the first period.

3. The method of driving the display device as defined in claim 2, wherein a ratio of the second voltage to the first voltage is set to 0.5 or less, and a ratio of the third voltage to the first voltage is set to more than 0.5 and less than 1.0.

4. The method of driving the display device as defined in claim 2, wherein the first through third voltages applied across said selected scanning electrode line and said selected signal electrode line in said selected period and a voltage applied across said selected scanning electrode line and said selected signal electrode line in a nonselected period are generated by giving two levels of electric potential to said selected scanning electrode line and signal electrode line, respectively, said two levels of electric potential being selected from six levels of electric potential in a different combination for each voltage.

5. The method of driving the display device as defined in claim 2, wherein the first through third voltages applied across said selected scanning electrode line and said selected signal electrode line in said selected period and a voltage applied across said selected scanning electrode line and said selected signal electrode line in a nonselected period are generated by giving two levels of electric potential to said selected scanning electrode line and signal electrode line, respectively, said two levels of electric potential being selected from eight levels of electric potential in a different combination for each voltage.

6. The method of driving the display device as defined in claim 1, wherein the 2-terminal type non-linear element is one of an MIM element and an MIS element.

7. The method of driving the display device as defined in claim 2, wherein the 2-terminal type non-linear element is one of an MIM element and an MIS element.

8. The method of driving the display device as defined in claim 4, wherein said six levels of electric potential given to said selected scanning electrode line and signal electrode line are V0, V1, V2, V3, V4, and V5 having a magnitude relationship expressed as V0>V1>V2>V3>V4>V5, the first through third voltages being set by equations V0–V5, V2–V3, one of V2–V5 and V0–V3, respectively.

9. The method of driving the display device as defined in claim 4, wherein said six levels of electric potential given to said selected scanning electrode line are V0, V1, V2, V3, V4, and V5 having a magnitude relationship expressed as V0>V1>V2>V3>V4>V5, and said six levels of electric potential given to said selected signal electrode line are V0, V1, V2', V3', V4, and V5 having a magnitude relationship expressed as V0>V1>V2'>V3'>V4>V5, the first through third voltages being set by equations V0–V5, V2'–V3, V0–V3, respectively.

10. The method of driving the display device as defined in claim 5, wherein said eight levels of electric potential given to said selected scanning electrode line and signal electrode line are V0, V1, V2, V3, V4, V5, V6, and V7 having a magnitude relationship expressed as V0>V1>V2>V3>V4>V5>V6>V7, the first through third voltages being set by equations V0–V7, V3–V4, V3–V6, respectively.

* * * * *